United States Patent [19]

Sauder

[11] 4,154,975

[45] May 15, 1979

[54] METHOD AND APPARATUS FOR SUPPORTING ELECTRIC HEATING ELEMENTS IN A FURNACE INSULATED WITH CERAMIC FIBER

[75] Inventor: Robert A. Sauder, Emporia, Kans.

[73] Assignee: Sauder Industries, Inc., Emporia, Kans.

[21] Appl. No.: 774,394

[22] Filed: Mar. 4, 1977

[51] Int. Cl.[2] ..... F27D 1/10; H05B 3/06

[52] U.S. Cl. ..... 13/25

[58] Field of Search ..... 13/20, 25, 35; 266/286; 110/1 A; 219/531, 536, 537

[56] References Cited

U.S. PATENT DOCUMENTS 4,088,825 5/1978 Carr ..... 13/25

*Primary Examiner*—R. N. Envall, Jr.

*Attorney, Agent, or Firm*—Arnold, White & Durkee

[57] ABSTRACT

An apparatus including an insulation module attachable to a furnace wall, an elongate anchor member completely embedded within the insulation module and generally parallel to a major surface of the module, and a support element having one end cooperable with a heating element and another end attachable to the anchor member is disclosed. A method including embedding an anchor member within an insulation module, affixing the module to a wall, inserting a support member into the module and engaging the anchor member therewith, and bringing a heating element into an engagement with another end of the support member is disclosed.

48 Claims, 9 Drawing Figures

METHOD AND APPARATUS FOR SUPPORTING ELECTRIC HEATING ELEMENTS IN A FURNACE INSULATED WITH CERAMIC FIBER

BACKGROUND OF THE INVENTION

This invention relates generally to a novel method and apparatus for supporting electric heating elements in a furnace insulated with ceramic fiber.

More particularly, this invention concerns a method and apparatus for utilizing a ceramic fiber insulation module of a unique design which is operable to support electric resistence heating coils with a minimum likelihood of short circuit or heat loss.

Electric industrial furnaces or ovens, particularly those used for annealing, include resistance heating elements. These elements are metallic ribbons or wires which have been formed into a serpentine or sinusoidal configuration and are ordinarily supported on hangers which are attached to the furnace wall or casing.

There are a wide variety of known techniques for constructing and insulating industrial furnaces utilizing electric heating elements. For example, a furnace may be constructed from steel and insulated either internally or externally with ceramic material. Some furnaces are constructed of fire brick or have a fire brick lining inside a steel casing. In any event, to achieve satisfactory thermal efficiency, industrial furnaces will generally be provided with insulation of one form or another.

The resistence elements used in electric furnaces have a relatively short useful life as a result of failure or burnout. A failure or burnout may be occasioned by localized heating, short circuits, thermal stress in the heating elements, defects in the manufacture of the heating elements, or a variety of other known reasons. Therefore, these heating elements need to be replaced or repaired from time to time. When replacement or repair is required, it is necessary to cool the furnace to enable personnel to effect the necessary repairs. The shutting down of a furnace results in expensive downtime for the operator of the furnace, and additionally, results in an enormous waste of fuel and energy.

In the past, it has been common to insulate high temperature furnaces and the like with ceramic fiber insulation modules. These modules may take a variety of forms. For example, there is available an insulation module comprised of resilient fiber insulation arranged with the fibers or planes of the fibers lying in planes generally perpendicular to the major surfaces of the module. Other modules are fashioned from ceramic fiber insulation blanket which has been folded into an accordian or serpentine arrangement and then compressed slightly. Yet other modules are available which are comprised of vacuum-formed ceramic fiber and which are relatively rigid in construction. In addition, ceramic fiber insulation blanket may be used without benefit of folding or rearrangement and the like to provide satisfactory insulation characteristics. In any event, the term "module" is intended to encompass all of these as well as other types of furnace insulation materials.

When insulation modules of the ceramic fiber type are utilized to insulate a furnace, these modules are ordinarily impaled on studs which are welded or otherwise attached to the furnace casing or wall. These studs serve both to maintain the insulation module in position and to provide an anchoring arrangement to support electric resistence heating elements. Other arrangements are known whereby an anchor for a heating element is embedded in fire brick used to construct or insulate the interior of a furnace. When the interior of the furnace is lined with fire brick, and metallic anchors have been secured to the fire brick, an electric heating coil is affixed to these anchors.

Other known arrangements utilize ceramic panels which are positioned within a furnace in a manner overlying the interior insulation. Electric heating elements then are attached to the panel.

Many of the above problems are compounded in instances where it is desirable to replace only the insulation material in a furnace. That is, many known methods and apparatus for supporting electric heating elements are incompatible with any known arrangements for repairing or replacing insulation material. These known heating element support arrangements require an extensive and cumbersome dismantling in order to facilitate replacement of insulation.

In instances where it is desirable to construct a ceramic fiber veneer over the existing fire brick in a furnace, the construction of an entirely new system for supporting electric heating coils may be required. Because of the great expense in reconstructing a heating coil system, some furnace operators may be discouraged from repairing or replacing the insulation in their furnaces with the result that some furnaces may be operated at highly inefficient levels.

The problems ennumerated in the foregoing are not intended to be exhaustive, but rather are among many which tend to impair the effectiveness of previously known systems for supporting electric heating coils in a furnace. Other noteworthy problems may also exist; however, those presented above should be sufficient to demonstrate that those arrangements for supporting heating coils in a furnace known in the art have not been altogether satisfactory. Whereas prior art arrangements have exhibited at least a degree of utility in supporting electric resistence heating elements in a furnace, room for significant improvement remains.

OBJECTS AND SUMMARY OF A PREFERRED EMBODIMENT OF THE INVENTION

Recognizing the need for an improved method and apparatus for supporting electric heating coils in a furnace lined with ceramic fiber insulation, it is, therefore, a general object of the present invention to provide a novel method and apparatus which minimizes or reduces the problems of the type previously noted.

It is a more particular object of the present invention to provide a novel method and apparatus for supporting electric heating coils in a furnace which does not utilize an anchoring mechanism fastened directly to the furnace wall.

It is yet another object of the present invention to provide a novel method and apparatus for supporting electric heating coils in a furnace which facilitates quick and easy replacement of electric heating coils.

It is still another object of the present invention to provide a novel method and apparatus for supporting electric heating coils in a furnace which may be utilized for conjunction with a layer of ceramic fiber insulation placed as a veneer over an existing layer of fire brick in a furnace.

It is yet still another object of the present invention to provide a novel method and apparatus for supporting electric heating coils in a furnace which will minimize the detrimental affects to the heating coils and minimizing the frequency of furnace shut-down to repair or replace the heating coils.

It is a further object of the present invention to provide a novel method and apparatus for supporting electric heating coils which includes supporting the electrical modules are attached to the furnace through means independent of the coil-supporting apparatus.

An apparatus for supporting an electric heating element in a furance according to a presently preferred embodiment of the invention intended to substantially accomplish the foregoing objects includes a ceramic fiber insulation module attachable to a furnace wall, an anchor member, preferably an elongate ceramic rod, embedded completely within the insulation module, and an S-shaped member, an end of which may be passed through the material comprising a face of the module and engaged with the anchor member and another end of which extends outside the insulation module to support an electric heating element. Ceramic spacers in the form of annular washers or elongate rods may be positioned between the heating element and the insulation module to maintain the element out of direct contact with the hot face of the module.

The method according to a presently preferred embodiment of the invention intended to substantially accomplish the foregoing objects includes introducing an elongate anchor member into the interior of a ceramic fiber insulation module, affixing the insulation module to a furnace wall, inserting a generally S-shaped support member into a face of the insulation module to hook a downward depending end of the S-shaped support member over the elongate anchor member, positioning the upward depending end of the S-shaped support member outside the insulation module, and placing an electric heating element in the upward depending end of the S-shaped support member. Ceramic spacers may be positioned between the electric heating coil and the module. The elongate member, or the S-shaped support member or both members are preferably made of electric insulative material.

Examples of the more important features of this invention have thus been summarized rather broadly in order that the detailed description thereof that follows may be better understood, and in order that the contribution to the art may be better appreciated. There are, of course, additional features of the invention that will be described hereinafter and which will also form the subject of the claims appended hereto.

DETAILED DESCRIPTION OF PREFERRED EMBODIMENTS OF THE INVENTION

Figure 1:
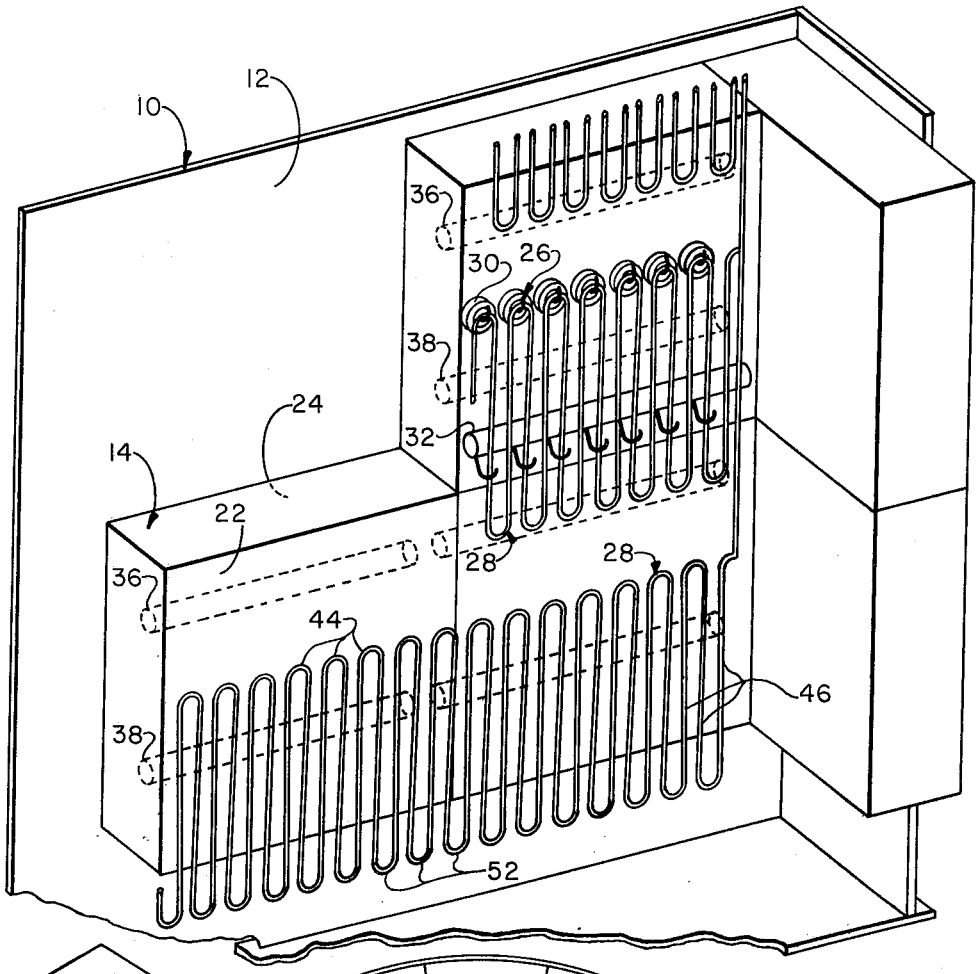
FIG. 1 is a perspective view of an electric furnace wherein heating coils have been installed in accordance with the present invention.

With reference now to the drawings wherein like referenced numerals have been applied to like elements, and in particular to FIG. 1, there can be seen a portion of a furnace 10 utilizing the method and apparatus of the present invention. This furnace is constructed from a series of metallic walls 12 which define a casing of the furnace 10. This casing is desirably insulated to prevent heat loss and to minimize the hazard to personnel in the vicinity of the furnace. Whereas a wide variety of materials and techniques are available for insulating a furnace, the present invention anticipates a system of insulation which is positioned within the interior of the furnace as opposed to those systems which may be applied to or assembled on the outside of the furnace.

A preferable insulation module 14 for use in conjunction with the present invention is a PYRO-BLOC brand thermal insulation module available from Sauder Industries, Inc., Emporia, Kansas, U.S.A. In preferred form, a module will have dimensions of approximately one foot square by four inches and will be comprised of resilient ceramic fiber wherein the fibers or the planes in which the fibers lie are arranged to lie in planes perpendicular to the walls 12 of the furnace, or the modules may be of the rigid type, manufactured by the vacuum forming process to provide a relatively rigid, non-compressible module. In any event, the characteristics of such a module are generally that it be made from an electrically and thermally insulating material.

The ceramic fiber insulation modules or blocks 14 may be affixed to the furnace casing 12 or to a layer of fire brick 16 (see FIG. 4) utilizing a variety of techniques. For example, the module 14 may be affixed to a steel furnace casing by means of a weldable stud 18 which is inserted into the interior of the insulation module 14 (see FIG. 3). A weldable metallic stud 18 suitable for attaching a ceramic fiber insulation module of the present type is disclosed in U.S. Pat. No. 3,706,870 to Sauder et al. (See also U.S. Pat. No. 3,993,237 to Sauder et al.) With such an arrangement, a stud may be utilized to secure to the furnace casing 12 an expanded metal substrate 20 affixed to the back of the insulation module. Alternatively, a ceramic fiber insulation module may be adhesively affixed to the steel casing 12 or to a layer of fire brick 16. At least one adhesive is available from Sauder Industries, Inc., Emporia, Kansas, U.S.A., which demonstrates the appropriate chemical, mechanical and thermal characteristics to provide a reliable bond between the insulation module and the surface to which it is attached.

It will, of course, be appreciated that whatever insulation material is utilized in the interior of the furnace, there will be a hot face 22 which faces the interior of the furnace and a cold face 24 which is the surface adjacent the furnace casing or wall. The cold face 24 is the surface of the insulation material which is affixed to the furnace casing or wall.

In accordance with the present invention, a series of S-shaped support members 26 extend out from the hot face 22 of the insulation module 14 to provide a support for an electric resistence heating element 28 which will usually be arranged in a serpentine configuration for greatest efficiency. To improve the thermal characteristics of the heating coil 28, it may be desirable to position the heating coil out of direct contact with the hot face 22 of the insulation module 14. A ceramic annular spacer 30 and a ceramic rod 32 may be utilized as shown, for example, in FIGS. 2 and 3 to maintain the heating coil a short distance away from the hot face of the insulation module.

As may be seen from the drawings, at least one anchor member 34 is positioned within the interior of the insulation module 14. This member 34 is preferably a ceramic tube which may be precisely the same type as that used as the spacer 32. It has been found to be advantageous to position the anchor member a distance from the hot face 22 of the module corresponding to between 25–50% of thickness of the module. This anchor member 34 is preferably shorter in length than the width of the insulation module to avoid the member's interfering with the assembly or installation of the insulation module 14 on the furnace wall 12. Moreover, in the case of an insulation module which is comprised of resilient fibrous insulation material, there is facilitated a slight compression of the module during attachment to the furnace wall which may be accomplished without having an anchor member protrude through an edge of the module. Additionally, a small allowance should be made for the thermal growth of the anchor member to prevent severe end compression.

Figure 3:
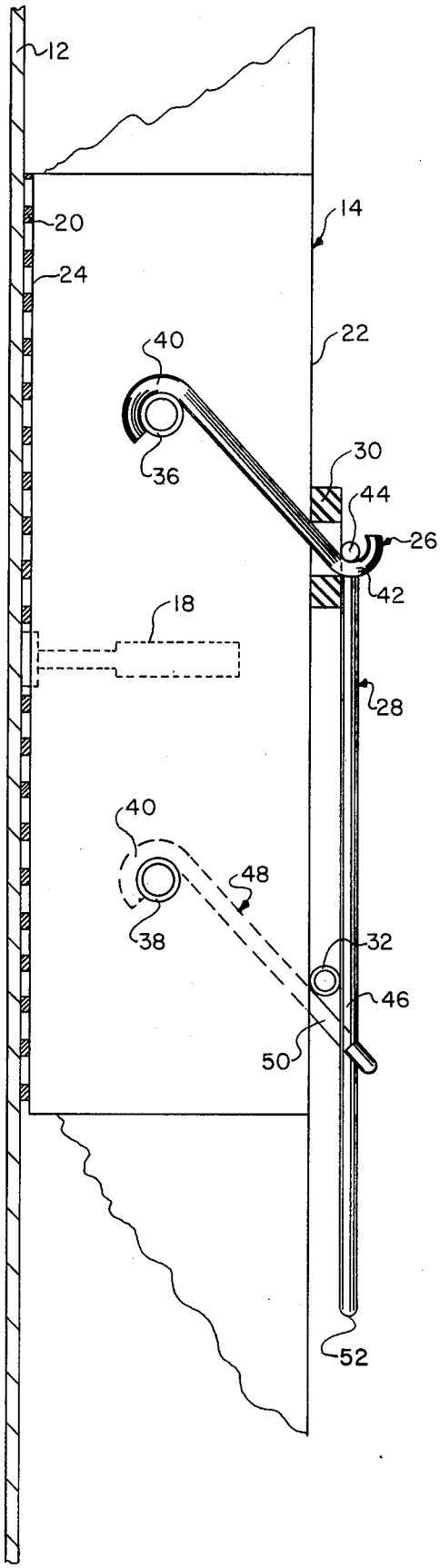
FIG. 3 is a cross-sectional view taken along section lines 3—3 in FIG. 2.
Figure 2:
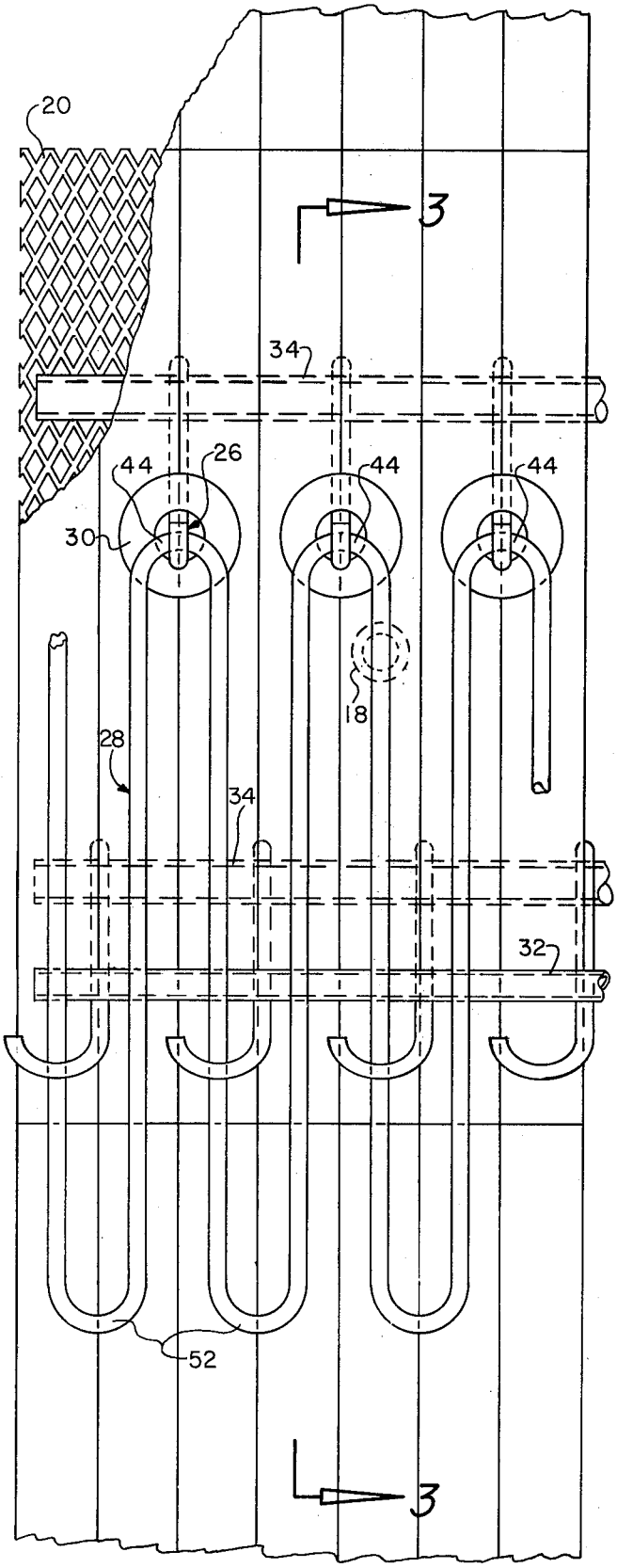
FIG. 2 is a partial-sectional view of a portion of the furnace depicted in FIG. 1 wherein details of the support for the heating coils have been shown in greater detail.
Figure 5:
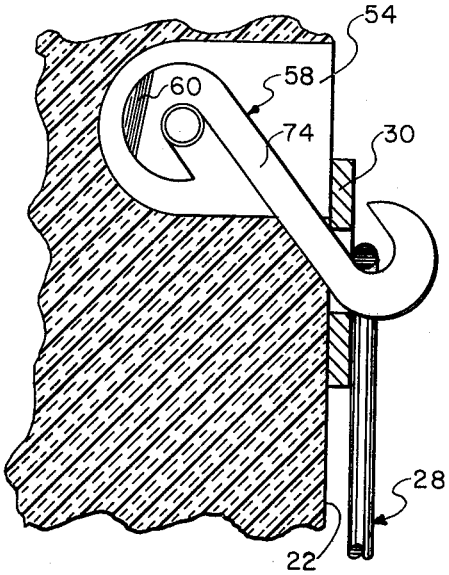
FIG. 5 is a fragmented, cross-sectional view of a heating coil supported from a ceramic fiber insulation module of the type depicted in FIG. 4.

As may be seen in FIGS. 2 and 3, in preferred form, the apparatus incorporates two anchor members 34, namely, a first or upper anchor rod 36 and a second or lower anchor rod 38. After the module has been affixed to a wall by means of a welded stud or an adhesive, the S-shaped support member 26 is inserted into the hot face 22 of the module 14. The support member 26 may be made from alloy steel or other appropriate material capable of withstanding the temperatures anticipated within the furnace chamber. As may be seen, for example, in FIG. 3, an end of the support member 26 with a downward depending hook 40 is inserted past the fibrous material comprising the insulation module and over the anchor rod 36 embedded therein. The support member 26 is of a sufficient length such that after the downward depending end 40 has been "hooked" onto the anchor rod 36, a sufficient length extends beyond the hot face 22 of the module to provide an upward depending hook 42 for engaging an upper loop 44 of the heating element 28. The support element 26 should be of sufficient length to permit the placement of the spacer 30 between the hot face 22 of the module and the heating element 28. As noted above, this spacer 30 is preferably an annular ceramic member; however, a variety of materials and geometries would be appropriate.

With the heating element supported at a center of the upper loop 44 of the heating element 28, a lower portion 46 of the heating element 28 will remain spaced apart from the hot face 22 of the module by substantially the distance represented by the thickness of the spacer 30. However, in instances where the heating element is to be supported on a inclinable wall or where it is necessary to maintain a continuous space between the element and the insulation hot face, it may be desirable to provide support for the lower portion 46 of the heating element. This may be accomplished in a related manner to the support provided for the upper loop of the heating element.

A lower support element 48 is inserted into the hot face of the insulation module and past the fibrous insulation material to engage the second anchor rod 38 embedded in the module. The lower support member is similar to the upper support element 26 in that both have loops or "hooks" at either end. However, this lower support member 48 has a 90° twist between the planes of the loops formed at the opposite ends thereof. This 90° twist facilitates engagement of the heating element 28 at a location along a vertical portion of the lower end 46. The spacer 22 may be positioned between the heating element 28 and the hot face 22 of the insulation module at this second or lower location. Whereas a spacer element 30 of the type used in conjunction with the upper support element may be used, it has been found expedient to use a ceramic rod similar to that used as the anchor member 38 as the lower spacer 32. This ceramic rod would be positioned between the heating element 28 and the hot face 22 of the module directly above a portion 50 of the lower support member 48 extending out from the hot face.

In instances where a resilient ceramic fiber insulation module 14 is utilized, the support member may be inserted at any desired location along the hot face of the module because the fibers will be readily displaced as the support member is inserted into the hot face. This module may be comprised of a series of side-by-side strips which are associated together in a now-known manner to form a single module. It is not necessary that the support members be inserted into the hot face of the module at any particular location in relation to the interfaces between these strips.

Figure 9:
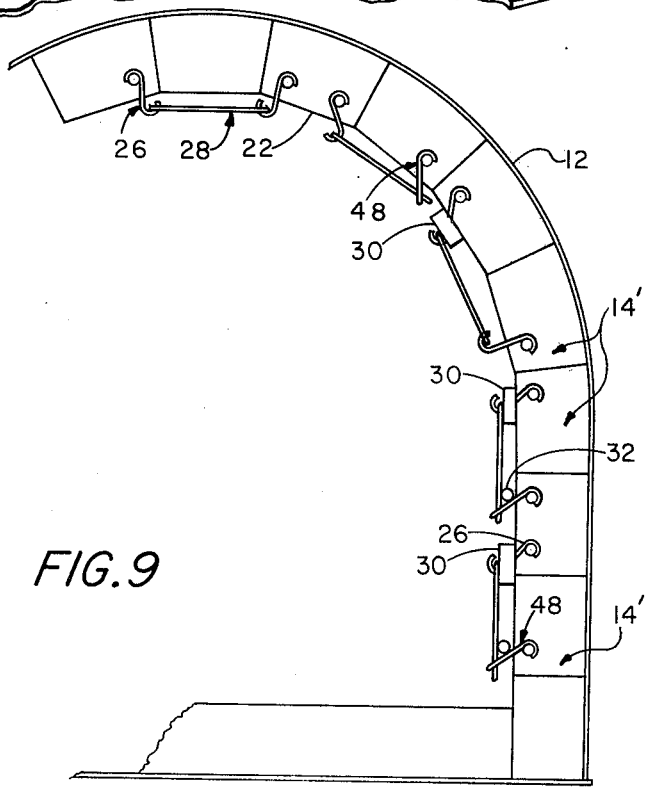
FIG. 9 is a cross-sectional view of a curved-wall furnace incorporating the present invention.

Thus it can be seen that a serpentine electric resistence heating element 28 may be supported within the interior of a furnace by attaching a series of upper support members 26 to the anchor rod 36 in a module 14. Adjacent upper support members will be separated by a distance corresponding to the centers of the upper loops 44 of the heating coil. In instances where a sloping wall or a ceiling is encountered, the heating element 28 may be supported both at or near the upper loop 44 and at or near a lower loop 52 in a manner depicted in FIG. 9. As will be apparent to those skilled in the art, it may be desirable to use either or both the S-shaped support member 26 and the 90° twisted support member 48 when attaching heating coils on sloping walls or on the ceiling of a furnace. Whereas it is preferable to utilize a module having two anchor rods 36 and 38, it will be appreciated that modules having one (e.g., modules 14' in FIG. 9) or three or any number of anchor rods may be fabricated in accordance with the present invention and that the support elements 26 and 48 may be of varying lengths to provide an extremely flexible system for supporting heating elements in furnaces having a wide variety of geometries. Moreover, it will be appreciated that the method and apparatus of the present invention may be utilized in the positioning of gas lines or gas jets (not shown) in a gas-fired furnace (also not shown). That is, a relatively straight gas pipe could be supported by a series of support elements 26 in accordance with the present invention. With such an arrangement many rows of gas jets could be conveniently and quickly installed.

Figure 4:
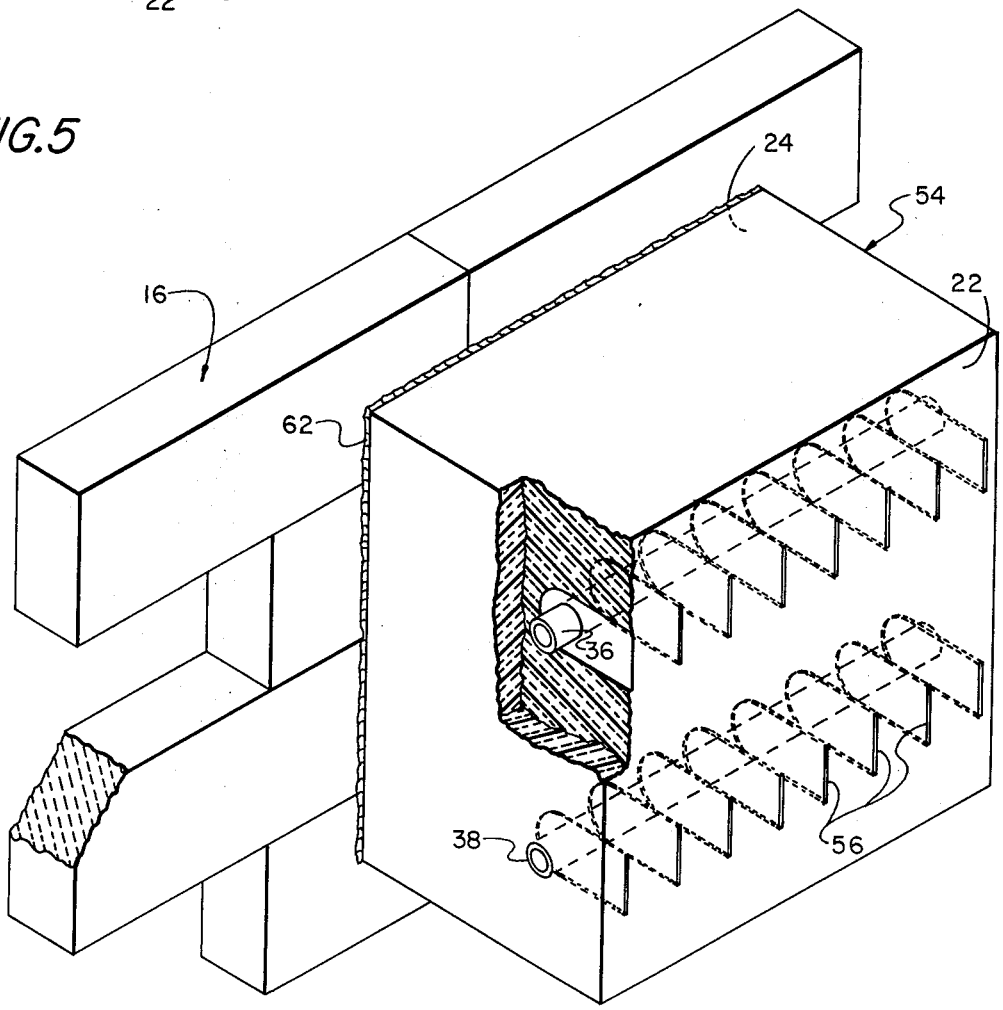
FIG. 4 is a fragmented, partial-sectional, perspective view of an alternative embodiment of the method and apparatus of the present invention.

With reference now to FIGS. 4–7, there may be seen apparatus comprising an alternative embodiment of the present invention. FIG. 4 depicts a ceramic fiber insulation module 54 which has been vacuum-formed. Such a module 54 is relatively rigid, and the fibers are in a somewhat brittle condition. Therefore, it may be preferable to introduce a series of kerfs or cuts or slots 56 along the hot face 22 of the module 54 to facilitate insertion of a relatively flat support member 58 into the hot face for the purpose of engaging an anchor rod. These kerfs may be made in the module either prior to or subsequent to the time the ceramic anchor rods 36 and 38 are introduced.

Figure 6:
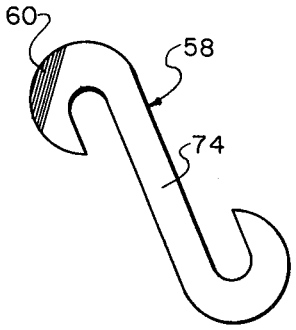
FIG. 6 is a front view of an S-shaped support member employed in conjunction with the arrangement shown in FIG. 5 and which may be used in the arrangement shown in FIG. 4.
Figure 7:
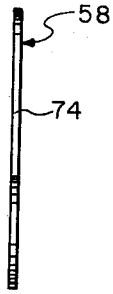
FIG. 7 is a side view of the apparatus of FIG. 6.

In order to minimize any undesirable heat transfer through the kerfs, it is desirable to use the relatively flat support member 58 as shown in FIGS. 6 and 7. This support member is substantially S-shaped as shown in the drawings and has a sharpened edge 60 at one end. This sharpened edge 60 facilitates insertion of the support member 58 through the ceramic fiber insulation material, particularly in the case of a rigid insulation module wherein this edge 60 may obviate the need for the precut kerf 56. Even in the case of a module with precut kerfs 56, this sharpened edge may facilitate engagement of the support member 58 with the anchor rod 36 or 38.

As noted earlier, the relatively rigid insulation block 54 may be advantageously affixed with an adhesive 62 to the metal casing of a furnace or to an existing layer of fire brick. In either event, the strength of the adhesive 62 should be sufficient to support the additional weight of the heating element 28, the anchor rods 36 and 38, and the support members 58.

Figure 8:
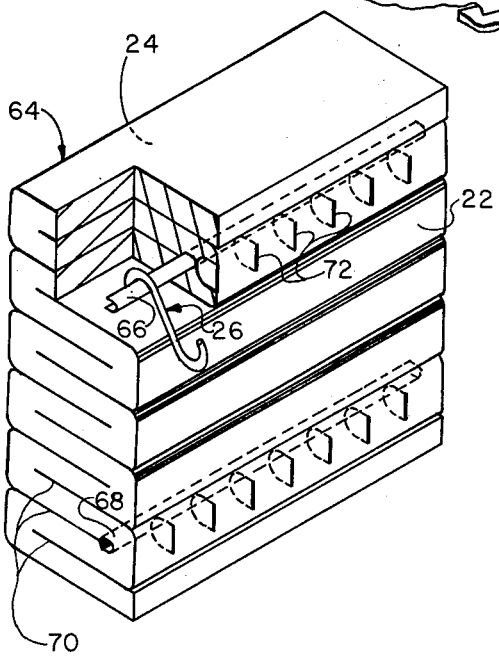
FIG. 8 is a fragmented, partial-sectional, perspective view of an alternative arrangement for practicing the present invention.

Yet another alternative embodiment of the apparatus of the present invention includes a ceramic fiber insulation module 64 fashioned from a single mat of fibrous, resilient insulation material which has been arranged in a serpentine or accordian fashion as shown in FIG. 8. A substrate or other arrangement (not shown) may be utilized to maintain the structural integrity of the module thus formed. An upper and lower ceramic anchor member 66 and 68 respectively, which may be cylindrical or U-shaped in cross-section, are each inserted into a fold 70 of the fiber bat either during or subsequent to assembly of the module 64. It may be desirable to precut kerfs 72 in the module 64 to facilitate passing a support member into the hot face 22 of the module and over the anchor member 66 or 68. Either a wire-like support member 26 or 48 as depicted in FIG. 3 a relatively flat support member 58 as depicted in FIGS. 6 and 7 may be utilized.

It will, of course, be appreciated that the support members utilized in connection with the module 64 may have the loops formed at its opposite ends lying in the same plane, e.g., for an upper support member, or may have a 90° twist as in the case of the lower support member 48 in FIG. 3. Utilization of a relatively flat support member 58 of the type shown in FIGS. 6 and 7 with a 90° twist is within the scope of the invention, and its preferable to form the twist at a point along its shank member 74 at a location which will lie outside the module 64.

In the case of the ceramic fiber insulation module 14 or 64 comprised of fibrous, resilient ceramic fiber, it will be found that when the support member is inserted into the hot face 22 of a module and moved into engagement with the anchor member, the ceramic fiber will tend to expand into any voids created during the insertion of the support member. However, in the case of a rigid ceramic fiber insulation module 54, when a kerf 56 is made in the material, the surrounding fiber will not expand into the kerf thus formed. Therefore, it may be desirable to introduce a small amount of fibrous material or the like into the kerf after the support member 58 has been positioned. This would minimize any hot spots which might occur as a result of a small region of reduced insulation thickness between the interior of the furnace and the wall of the furnace.

SUMMARY OF ADVANTAGES AND SCOPE OF THE INVENTION

It will be appreciated that in utilizing the method and apparatus according to the present invention, certain significant advantages are provided. In particular, electrical heating elements may be supported within a furnace chamber without the necessity of attaching a series of studs to the furnace casing. Moreover, the present invention enables electric heating elements to be supported either horizontally or vertically or at any selected angle therebetween. Replacement or repair of malfunctioning electric heating elements may be accomplished quickly and easily. It will be appreciated that in the event an electric heating element having the identical dimensions is not available as a replacement for a damaged or malfunctioning element, the support members may be repositioned to accommodate the different geometry. That is, if the spacing between the centers of the upper loops are different, it is relatively easy to move the support elements to a new position on the anchor element.

In addition, it will be appreciated that no special tools are required to practice the present invention. Electric heating elements may be installed by relatively unskilled labor with a minimum of training.

The apparatus in direct contact with the heating element is independent of the hardware which may be used to attach to the wall of the furnace the insulation module carrying the anchor member. This advantageously eliminated thermal stress which may have been transmitted to such hardware as a result of conduction between the heating element and the attachment hardware. Moreover, in instances where the apparatus in direct contact with the furnace casing is also in direct contact with the heating elements, hot spots may occur along the furnace casing as a result of conduction. These hot spots affect both the structural integrity of the support system for the heating element and produce a hazard to personnel in the vicinity of the furnace.

The foregoing description of the invention has been directed to several particular preferred embodiments in accordance with the requirements of the Patent Statutes and for purposes of explanation and illustration. It will be apparent, however, to those skilled in this art that many modifications and changes in both apparatus and method may be made without departing from the scope and spirit of the invention. For example, engagement of the support arm and the anchor rod might be accomplished through an arrangement other than a hook, e.g., the support member might be threaded to the anchor. The anchor member may have a variety of lengths and cross-sectional geometry. For example, a blade-like member extending only partially through a module is anticipated to be within the scope of the invention. Also, ceramic fiber insulation modules of different structures may be utilized in the practice of the present method and apparatus.

It will be further apparent that the invention may also be utilized, with suitable modifications within the state of the art, for affixing refrigerating coils to the interior of a refrigerating or freezing compartment. These, and other modifications of the invention will be apparent to those skilled in this art. It is the Applicant's intention in the following claims to cover all such equivalent modifications and variations as fall within the true spirit and scope of the invention.

What is claimed is:

1. A method of installing an electric heating element in a furnace comprising the steps of:

introducing an elongate anchor member into the interior of a fibrous insulation module;

affixing the insulation module to a furnace wall;

inserting a generally S-shaped support member into the fibrous insulation module to hook a downward depending end of the S-shaped support member over the elongate anchor member;

positioning an upward depending end of the S-shaped support member outside the insulation module; and placing an electric heating element onto the upward depending end of the S-shaped support member.

2. The method of claim 1 wherein said affixing step comprises attaching a stud to the furnace wall and impaling the insulation module on the stud.

3. The method of claim 1 wherein said affixing step comprises applying an adhesive material to the furnace wall and bonding the adhesive material to the insulation module.

4. The method of claim 1 wherein prior to said step of inserting a generally S-shaped support member, a step is performed comprising forming a kerf between a face of the insulation module and the anchor member.

5. The method of claim 1 wherein the generally S-shaped member comprises a sharpened edge which forms a kerf in the insulation module when said step of inserting is performed.

6. The method of claim 1 wherein said method further includes the step of spacing the electric heating element out of direct contact with the insulation module.

7. A method of installing an electric heating element in a furnace comprising the steps of:

embedding an anchor member in the interior of an insulation member;

affixing the insulation member to a wall of a furnace;

inserting one end of an electric heating element support member into the insulation member;

operably engaging the one end of the support member and the anchor member; and operably engaging a second end of the support member and the electric heating element.

8. The method of claim 7 wherein said affixing step comprises attaching a stud to the furnace wall and impaling the insulation member on the stud.

9. The method of claim 7 wherein said affixing step comprises applying an adhesive material to the furnace wall and bonding the adhesive material to the insulation member.

10. The method of claim 7 wherein the insulation member comprises resilient ceramic fibers.

11. The method of claim 7 wherein the insulation member is comprised of rigid ceramic fibers.

12. The method of claim 7 wherein prior to said inserting step, a step is performed comprising forming a kerf between a face of the insulation member and the anchor member.

13. The method of claim 7 wherein the support member comprises a sharpened edge which forms a kerf in the insulation member when said step of inserting is performed.

14. The method of claim 7 wherein said method further includes the step of spacing the electric heating element out of direct contact with the insulation member.

15. The method of claim 7 wherein said support member comprises a generally S-shaped member.

16. The method of claim 15 wherein said step of operably engaging the one end of the support member comprises hooking a downward depending end of the support member over the anchor member.

17. The method of claim 15 wherein said step of operably engaging a second end of the support member comprises placing an electric heating element onto an upward depending end of the support member.

18. Apparatus for supporting an electric heating element in a furnace comprising:

an anchor member positioned within a furnace insulation member, said anchor member being embedded within the insulation member; and an S-shaped engagement member operable to displace insulation lying between a hot face of the insulation member and the anchor member and to engage the anchor member;

said engagement member having at one end a support means for supporting an electric heating element.

19. The apparatus of claim 18 wherein said S-shaped engagement member is metallic.

20. The apparatus of claim 18 wherein said anchor member is a rod comprised of ceramic material.

21. The apparatus of claim 18 wherein said engagement member is comprised of a double-ended hook with the plane of one hook aligned approximately 90° with the plane of the other hook.

22. The apparatus of claim 18 wherein said engagement member is comprised of a substantially S-shaped member having a sharpened edge for cutting insulation lying between the hot face of the insulation member and said anchor means.

23. The apparatus of claim 22 wherein said S-shaped engagement member is metallic.

24. The apparatus of claim 18 wherein said apparatus further comprises spacing means positioned between the electric heating element and the hot face of the insulation member for maintaining the electric heating element out of direct contact with the insulation member.

25. The apparatus of claim 24 wherein said spacing means comprises an annular ceramic member.

26. The apparatus of claim 24 wherein said spacing means comprises a ceramic rod.

27. Apparatus for supporting an electric heating element in a furnace comprising:

an insulation module having a hot face and a cold face, said module being comprised of side-by-side strips of ceramic fiber, each of said strips arranged to lie in a plane substantially perpendicular to said hot face;

an elongate anchor member positioned within an interior of said module, said anchor member being arranged transversely with respect to the planes of said strips;

heating element support means having one end for supporting the heating element and having another end operable to displace insulation lying between said hot face of said module and said anchor member for engaging said anchor member at any desired location along a length thereof after said anchor member is positioned within said module and said module is attached to the furnace.

28. The apparatus of claim 27 wherein said support means is comprised of an S-shaped member.

29. The apparatus of claim 28 wherein said S-shaped engagement member is metallic.

30. The apparatus of claim 27 wherein said support means is comprised of a double-ended hook with the plane of one hook aligned approximately 90° with the plane of the other hook.

31. The apparatus of claim 27 wherein said support means is comprised of a substantially S-shaped member having a sharpened edge for cutting insulation lying between the hot face of the insulation module and said anchor member.

32. The apparatus of claim 31 wherein said S-shaped engagement member is metallic.

33. The apparatus of claim 27 wherein said apparatus further comprises spacing means positioned between the electric heating element and the hot face of the insulation module for maintaining the electric heating element out of direct contact with the insulation module.

34. The apparatus of claim 33 wherein said spacing means comprises an annular ceramic member.

35. The apparatus of claim 33 wherein said spacing means comprises a ceramic rod.

36. Apparatus for supporting an electric heating element in a furnace comprising:

a ceramic fiber insulation member attachable to a furnace casing;

an anchor member embedded within said insulation member, said anchor member being out of contact with the furnace casing;

a connector for engaging at a first end an electric heating element, said connector having a second end for removably engaging said anchor member to attach said connector to said anchor member.

37. The apparatus of claim 36 wherein said connector is comprised of an S-shaped member.

38. The apparatus of claim 36 wherein said S-shaped engagement member is metallic.

39. The apparatus of claim 36 wherein said connector is comprised of a double-ended hook with the plane of one hook aligned approximately 90° with the plane of the other hook.

40. The apparatus of claim 36 wherein said connector is comprised of a substantially S-shaped metallic member having a sharpened edge for cutting insulation lying between the hot face of the insulation member and said anchor member.

41. The apparatus of claim 36 wherein said apparatus further comprises spacing means positioned between the electric heating element and the hot face of the insulation member for maintaining the electric heating element out of direct contact with the insulation member.

42. The apparatus of claim 36 wherein said spacing means comprises an annular ceramic member.

43. The apparatus of claim 36 wherein said spacing member comprises a ceramic rod.

44. The apparatus of claim 36 wherein said insulation member is vacuum-formed.

45. The apparatus of claim 36 wherein said insulation member is comprised of a single mat of fibrous, resilient ceramic fiber.

46. The apparatus of claim 45 wherein said single mat is arranged in a sinusoidal configuration.

47. The apparatus of claim 36 and further comprising attachment means for attaching said insulation member to a wall of the furnace.

48. The apparatus of claim 47 wherein said attachment means comprises a stud weldable to a wall of the furnace, said stud being positioned remote from said anchor member.

* * * * *

UNITED STATES PATENT AND TRADEMARK OFFICE

CERTIFICATE OF CORRECTION

PATENT NO. : 4,154,975

DATED : May 15, 1979

INVENTOR(S) : Robert A. Sauder

It is certified that error appears in the above-identified patent and that said Letters Patent are hereby corrected as shown below:

Under item [56], References Cited, please add the following U.S. Patent Documents:

| | | | |
|---|---|---|---|
| --3,892,396 | 7/1975 | Monaghan | 13/25 |
| 1,686,010 | 10,1928 | Keene | 13/25 |
| 1,861,947 | 6/1932 | Woodson et al. | 13/25 |
| 4,011,394 | 3/1977 | Shelley | 13/25 |
| 3,987,237 | 10/1976 | Phillips et al. | 13/25-- |

Signed and Sealed this

*Nineteenth* Day of *August 1980*

[SEAL]

*Attest:*

SIDNEY A. DIAMOND

*Attesting Officer*

*Commissioner of Patents and Trademarks*